US005595500A

United States Patent [19]

Page

[11] Patent Number: 5,595,500

[45] Date of Patent: Jan. 21, 1997

[54] QUICK RELEASE ELECTRICAL CONNECTOR

[75] Inventor: Michael P. Page, Kincumber, Australia

[73] Assignee: Cooper Industries, Inc., Houston, Tex.

[21] Appl. No.: 310,299

[22] Filed: Sep. 22, 1994

[51] Int. Cl.[6] ..... H01R 13/62

[52] U.S. Cl. ..... 439/372; 439/347

[58] Field of Search ..... 439/345, 372, 439/310, 347, 296, 368, 369, 373

[56] References Cited

U.S. PATENT DOCUMENTS

| | | | |
|---|---|---|---|
| 3,345,604 | 10/1967 | Henschen et al. | 439/310 |
| 4,083,619 | 4/1978 | McCormick et al. | 439/310 |
| 4,658,212 | 4/1987 | Ozawa et al. | 439/310 |

*Primary Examiner*—Hien D. Vu

*Attorney, Agent, or Firm*—Burns, Doane, Swecker & Mathis LLP

[57] ABSTRACT

An electrical connector comprises a cast housing (11) having at least one end for electrical coupling to another electrical connector. A shaft (23) is slidably mounted in or upon the housing (11) and comprises a locking lug (24) for engagement with a part of another electrical connector. The electrical connector comprises further means engageable with the shaft (23) resulting in sliding movement of the shaft (23) to effect movement of the lug (24) for interaction thereof with the part of the other connector. Such means might comprise a lever (12) pivotally attached to the housing and connected to the shaft (23), or other means such as a rack and pinion arrangement (51, 52).

7 Claims, 6 Drawing Sheets

QUICK RELEASE ELECTRICAL CONNECTOR

FIELD OF THE INVENTION

The following invention relates to a quick release electrical connector or restrained receptacle for quick release application in the underground mining industry.

In the mining industry for example, low and high voltage, high current electrical cables must be securely interconnected. Existing means of coupling such connectors comprise a jacking screw having a pivotally connected handle at one end thereof, the screw being required to be rotated through numerous revolutions for connection and disconnection of the electrical couplings. Each revolution of the jacking screw requires pivoting of the handle. Such process is time consuming and cumbersome.

OBJECT OF THE INVENTION

It would be desirable to provide a quick release mechanism for connecting and disconnecting electrical couplings.

DISCLOSURE OF THE INVENTION

There is disclosed herein an electrical connector comprising:

a housing having at least one end for electrical coupling to another electrical connector, a shaft slidably mounted in or upon the housing and comprising a locking lug for engagement with a part of said another electrical connector, and means attached to or engageable with said shaft adapted to effect sliding movement of the shaft to thereby effect movement of the lug for interaction of said lug with said part of said another connector.

Preferably, said means to effect sliding of the shaft comprises a lever pivotally attached to the housing and connected to the shaft.

Preferably, locking means are provided to lock the shaft in a selected position.

Preferably, said locking means in an embodiment including a lever fixes the lever at a selected orientation relative to the housing.

Preferably the locking means comprises a gear fixedly mounted to or formed integrally with the housing and a ratchet pin pivotally mounted to the lever.

Preferably, the ratchet pin is connected to a rod, activated by a button located upon the lever.

Preferably, the lever is connected to the shaft by a linkage.

As an alternative to the provision of a pivotally attached lever, said means to effect sliding of the shaft might comprise a rack formed integrally with the shaft and a pinion mounted within the housing and engaged with the rack such that upon turning of a handle attached to the pinion, sliding of the shaft is effected.

Preferably, the lug is in the form of a cam having a wedge surface which upon rotation of the lug causes tightening of the same against the part of said other connector.

Preferably, said part of the other connector is a flange or groove about a periphery thereof.

BRIEF DESCRIPTION OF THE DRAWINGS

Preferred forms of the present invention will now be described by way of example with reference to the accompanying drawings, wherein.

DESCRIPTION OF THE PREFERRED EMBODIMENT

Figure 1:
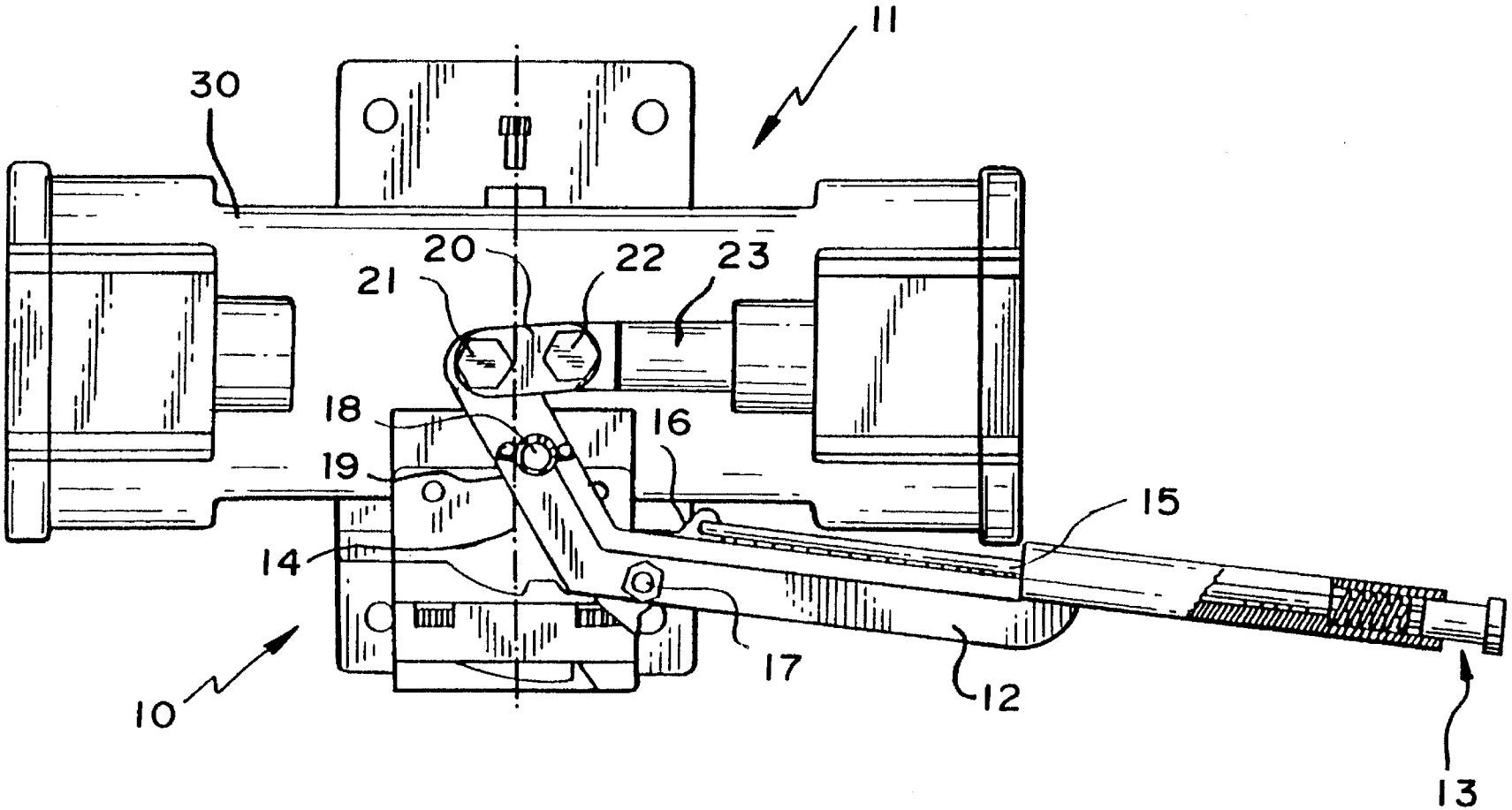
FIG. 1 is a schematic elevational view of an electrical connector.

In FIGS. 1 to 4 of the accompanying drawings there is schematically depicted a quick release mechanism 10 upon a coupling 11. Coupling 11 is typically a manganese bronze, copper free aluminium, a cast steel, or silicon graphite iron structure for connection of low and high voltage, high current cables in the underground mining industry. Attached to the coupling 11 at pivot point 18 is a lever 12 secured by split pin 19. Lever 12 has pivotally attached thereto a ratchet pin 16 connected by a rod 15 to a button 13 at the remote end of lever 12. Ratchet pin 16, being pivotally attached to lever 12 by nut and bolt assembly 17 cooperates with the teeth upon a curved rack or other gear assembly 14 either attached to or formed integrally with the coupling housing 11.

Figure 4:
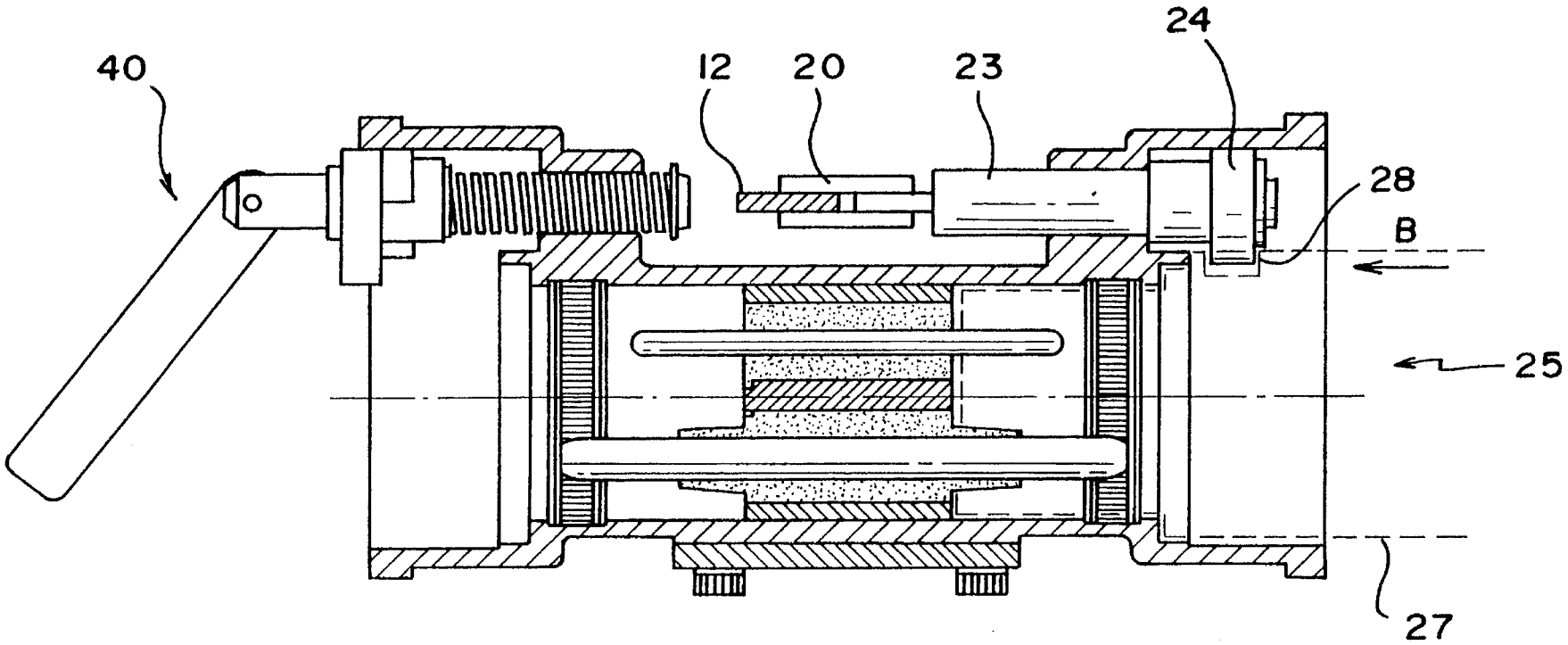
FIG. 4 is a schematic cross-sectional elevational view taken at 4—4 of FIG. 3.
Figure 4A:
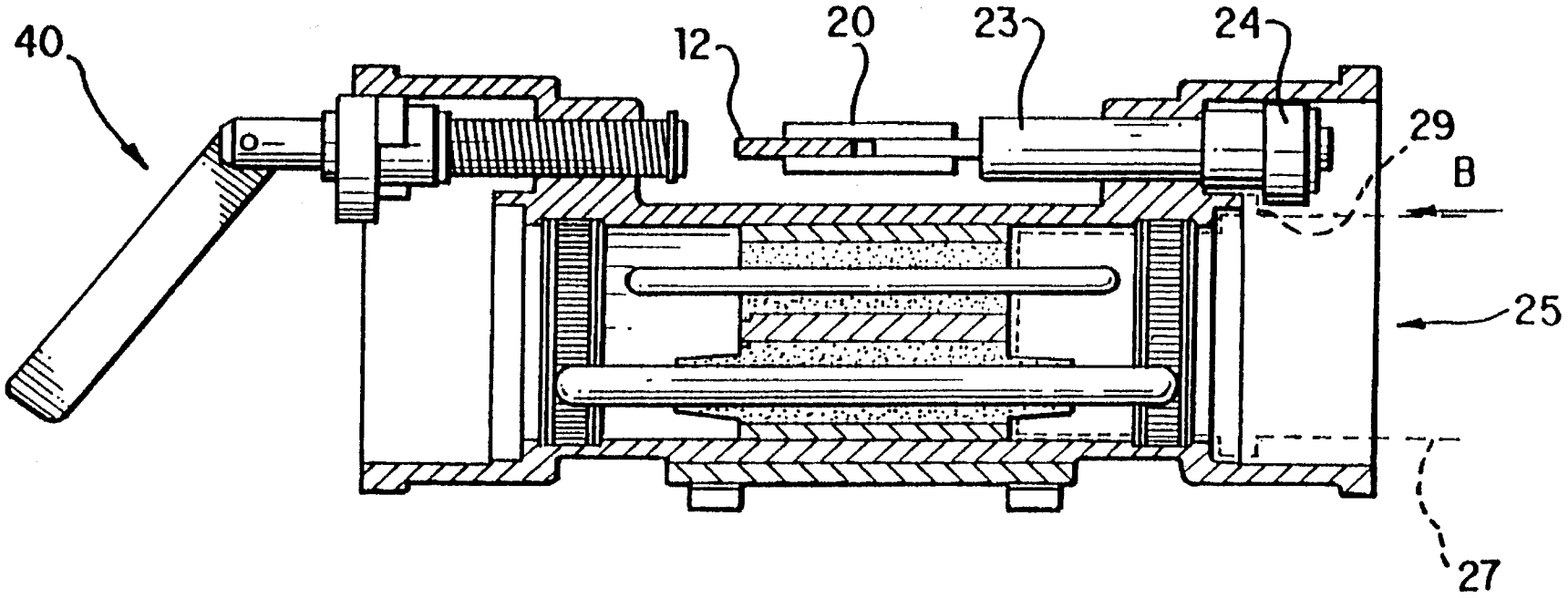
FIG. 4*a* is a schematic cross-sectional elevational view taken at 4—4 of FIG. 3 and illustrating a connector having a flange.
Figure 5A:
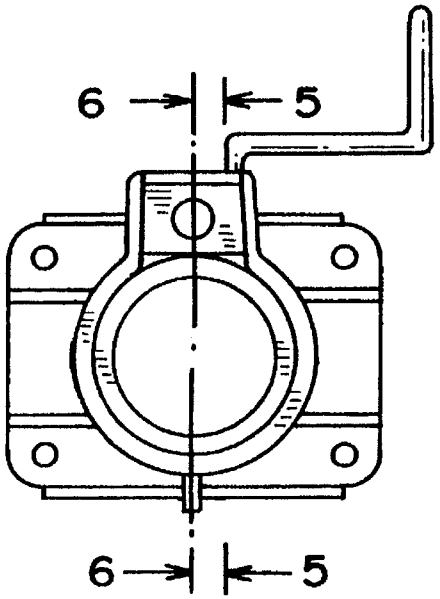
FIG. 5*a* is a schematic front elevational view of an electrical connector according to an alternative embodiment of the invention.
Figure 5B:
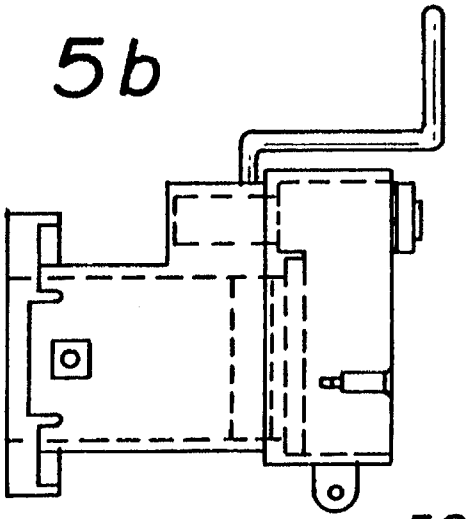
FIG. 5*b* is a schematic side elevational view of the electrical connector of FIG. 5*a*.
Figure 5C:
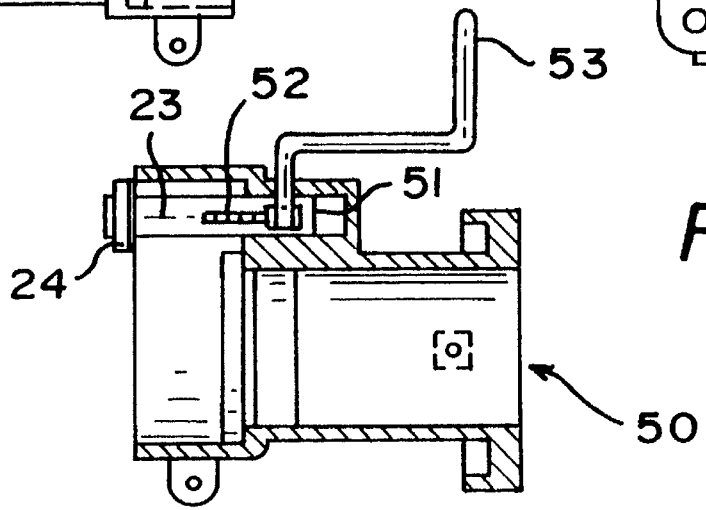
FIG. 5*c* is a schematic cross-sectional view of the electrical connector of FIG. 5*a* taken along 5—5.
Figure 5D:
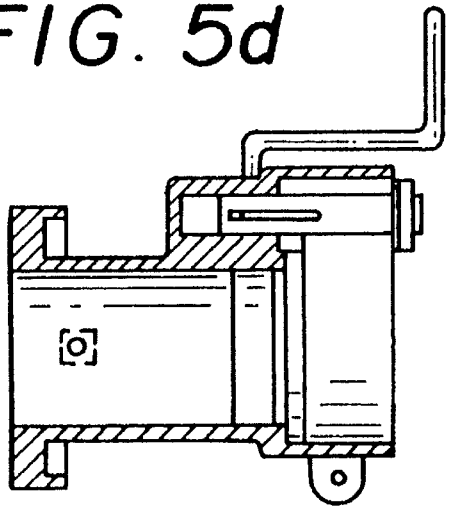
FIG. 5*d* is a schematic cross-sectional view of the electrical connector of FIG. 5*a* taken along 6—6.

At the other end of lever 12 there is pivotally attached at 21 a link 20 being also pivotally attached at 22 to a sliding member 23 (best depicted in FIG. 4). At the other end of sliding member 23 is a lug or cam 24 to engage a peripheral lip or groove formed in a mating connector.

Upon pivoting of lever 12 to the right and upward in FIG. 1, and by action of link 20, the sliding member 23 and lug or cam 24 move in the direction indicated by arrow B in FIG. 4. When cam 24 is outside of housing 11, the cam 24 may be rotated manually out of the way of the peripheral flange 29 or grove 28 of a mating coupling. When the mating coupling 27 is inserted to the cavity 25, the lug 24 may be located into engagement with its peripheral lip 28 whereupon the lever 12 is pivoted from an orientation approximately 75°–80° downward from that depicted in FIG. 1 to the orientation depicted at in FIG. 1 whilst drawing the mating coupling into cavity 25 as the button 13, rod 15 or ratchet pin 16 may be spring loaded, the lever 12 is prevented from being removed from the closed position depicted at FIG. 1 by interaction of the ratchet pin 16 with the teeth on a pinion of the gear assembly 14. When release of the couplings is desired, the button 13 is simply depressed, releasing ratchet pin 16 and allowing the lever 12 to be pivoted outwardly from the housing 11 to the orientation approximately 75°–80° from that depicted at FIG. 1. By this action, the sliding member 23 is moved to the right (FIG. 4), releasing lug 24 from the peripheral lip of the mating coupling.

Figure 2:
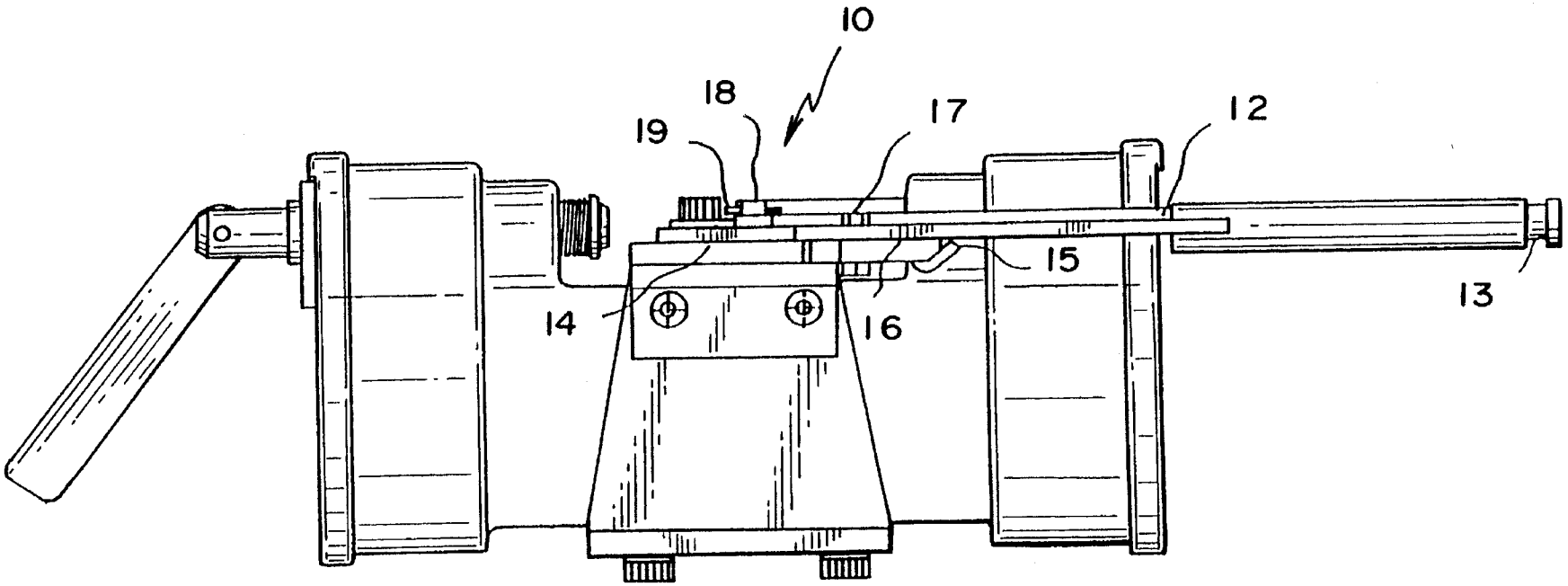
FIG. 2 is a schematic plan view of the connector of FIG. 1.
Figure 3:
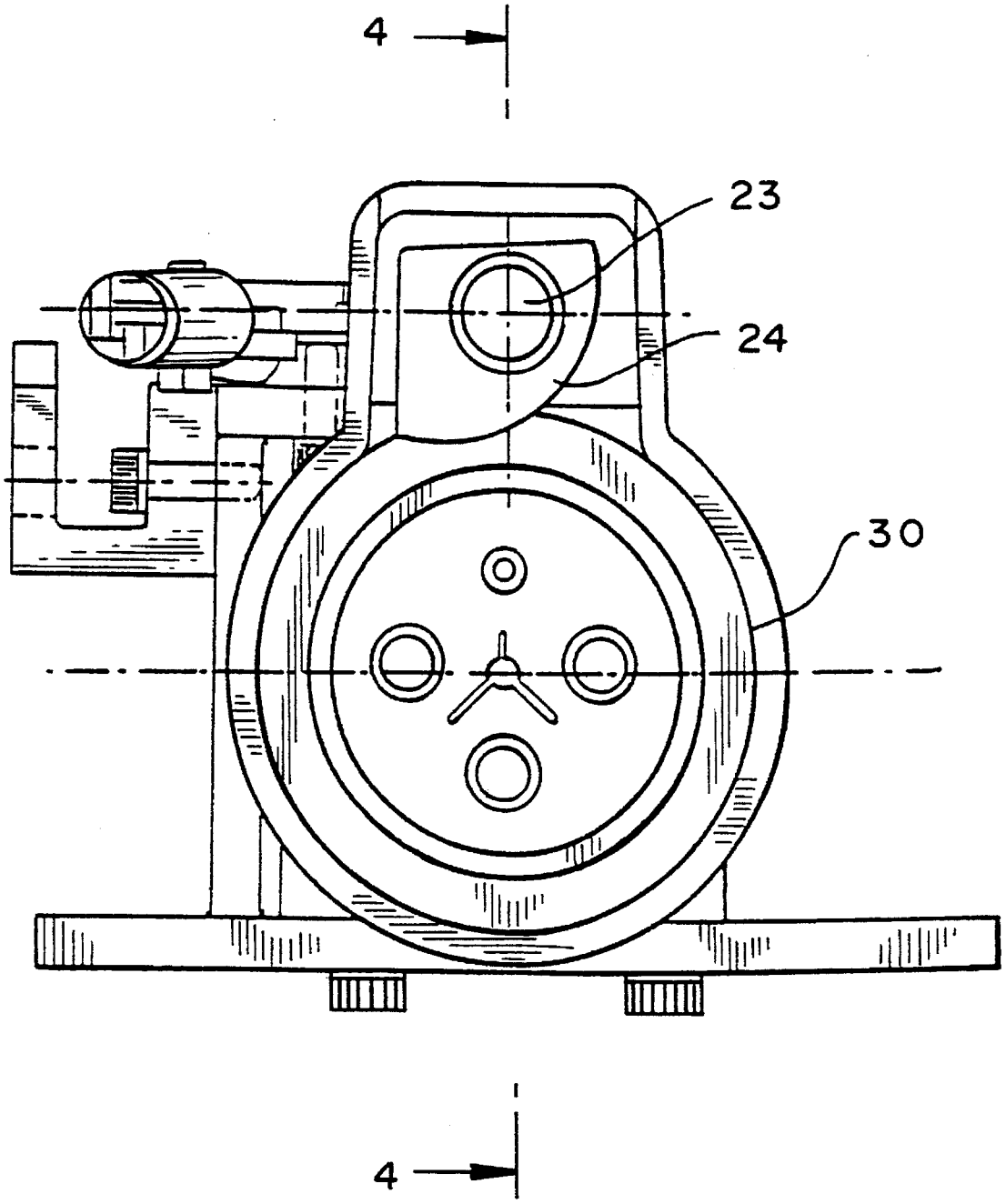
FIG. 3 is a schematic end elevational view of the connector of FIGS. 1 and 2.

A prior art type jacking screw 40 is depicted in FIGS. 2 and 4 for reference purposes only. It is intended that the quick release mechanism as described herein will be compatible with all types of couplings for which the standard jacking screw 40 is adapted to engage.

FIGS. 5*a–d* depict an electrical coupler 50 having an alternative means of transferring sliding member 23. In this embodiment a rotatably mounted handle 53 has a pinion 51 engageable with a rack 52 machined directly into the sliding member 23. Alternatively, the rack 52 might be attached to the sliding member 23 by any convenient means such as bolts. The handle 53 might extend through an aperture in the casting of connector 50. Upon rotation of handle 53, pinion 51 would rotate therewith. Rotation of pinion 51 which meshes with the teeth of rack 52 would effect the desired sliding movement of member 23.

In a further embodiment (not depicted) other means of sliding the member 23 may be provided. For example, member 23 might be provided with a threaded end engageable with an internally threaded turning wheel mounted on the housing. Such a turning handle might cooperate with the housing to effect longitudinal transfer of the sliding member 23. For example, the wheel might be provided with an internal thread engageable with external thread on the shaft 23. The wheel might partially reside within a recess or slot formed in the housing.

It should be appreciated that modifications and alterations obvious to those skilled in the art are to be considered as within the scope of the present invention. For example, in respect of the embodiment of FIGS. 1 to 4, any suitable means of locking the lever 12 into a closed orientation may be adopted. Such a mechanism might include a series of holes in coupling 30 and a pin transversly located in lever 12 for engagement therewith.

Furthermore, it should be appreciated that this invention is equally applicable to any electrical receptacle or back-to-back coupler or other electrical component or components requiring interconnection.

The claims defining the invention are as follows:

I claim:

1. An electrical connector comprising:

a housing having at least one end for electrical coupling to another electrical connector, a sliding member slidably attached to the housing and comprising a locking lug for engagement with an engagement part of said another electrical connector, a lever pivotally attached to the housing and pivotally connected to the sliding member by pivot means to effect sliding movement of the sliding member to thereby effect movement of the lug for interaction of said lug with said engagement part of said another connector, and locking means to lock the sliding member in a selected orientation relative to the housing, wherein the locking means includes a gear on the housing and a ratchet pin pivotally mounted on the lever.

2. The electrical connector of claim 1 wherein the ratchet pin is connected to a rod, activated by a button located upon the lever.

3. The electrical connector of claim 1 wherein the lever is connected to the sliding members by a linkage.

4. The electrical connector of claim 1 wherein the lug is in the form of a cam having a wedge surface which upon rotation of the lug causes tightening of the lug against the engagement part of said other connector.

5. The electrical connector of claim 1 wherein said engagement part of the other connector is a flange or groove about a periphery thereof.

6. An electrical connector comprising:

a housing having at least one end for electrical coupling to another electrical connector;

a sliding member slidably mounted to the housing and including a locking lug for engagement with an engagement part of said another electrical connector;

actuating means for effecting sliding movement of the sliding member to thereby effect interaction of the lug with said engagement part of said another connector, wherein the actuating means for effecting sliding movement is a lever or a handle; and locking means for locking the sliding member in a selected position, said locking means including a ratchet pin and ratchet engaging teeth, wherein the locking means locks the lever or handle in a particular position when the ratchet pin engages the ratchet engaging teeth.

7. The electrical connector of claim 6 wherein said lever means is a lever which is connected to the sliding member by a pivotable linkage.

* * * * *